US006450609B1

(12) United States Patent
Premnath et al.

(10) Patent No.: US 6,450,609 B1
(45) Date of Patent: Sep. 17, 2002

(54) METHODS FOR CHARGING AND PRIMING FLUID EJECTOR HEADS

(75) Inventors: Karai P. Premnath, Rochester, NY (US); William L. King, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/780,432

(22) Filed: Feb. 12, 2001

(51) Int. Cl.[7] ..... B41J 2/165
(52) U.S. Cl. ..... 347/30; 347/29
(58) Field of Search ..... 347/30, 29

(56) References Cited

U.S. PATENT DOCUMENTS 4,638,337 A 1/1987 Torpey et al.
4,679,059 A 7/1987 Dagna
4,746,938 A 5/1988 Yamamori et al.
4,849,774 A 7/1989 Endo et al.
4,853,717 A 8/1989 Harmon et al.
4,855,764 A 8/1989 Humbs et al.
5,055,856 A * 10/1991 Tomii et al. ..... 347/30
6,123,408 A * 9/2000 Ishize et al. ..... 347/30

FOREIGN PATENT DOCUMENTS

JP 10-100451 A * 4/1998 ..... B41J/2/165

* cited by examiner

*Primary Examiner*—Judy Nguyen
(74) *Attorney, Agent, or Firm*—Oliff & Berridge, PLC

(57) ABSTRACT

A priming method for a fluid ejection system that divides the priming schedule for the ink ejector into two parts (charging and priming). Priming is well known in the industry and is a high negative pressure pulse of short duration to minimize print quality defects and to remove air bubbles in the printhead. Charging is a low negative pressure profile of longer duration to prepare dry or new printhead for use and to minimize discontinuities and ink flow when a new ink jet cartridge is installed.

19 Claims, 3 Drawing Sheets

2853
09/780,432

METHODS FOR CHARGING AND PRIMING FLUID EJECTOR HEADS

BACKGROUND OF THE INVENTION

1. Field of Invention

This invention relates generally to maintenance stations for fluid ejection system.

2. Description of Related Art

In a thermal fluid ejector, the power pulses that result in a rapidly expanding gas bubble to eject the fluid from the nozzle are usually produced by resistors. Each resistor located in a respective one of a plurality of channels. Each resistor is individually addressed by voltage pulses to heat and vaporize fluid in the channels. As voltage is applied across a selected resistor, a vapor bubble grows in that particular channel and fluid bulges from the channel orifice. At that stage, the bubble begins to collapse. The fluid within the channel retracts and separates from the bulging fluid, which forms a droplet moving in a direction away from the channel orifice and towards the receiving medium. The channel is then re-filled by capillary action, which in turn draws fluid from a supply container. Operation of one type of a thermal fluid ejector, a thermal ink jet printers, is described in, for example, U.S. Pat. No. 4,849,774.

One particular form of thermal fluid ejection system is a thermal ink jet printer described in U.S. Pat. No. 4,638,337. That ink jet printer includes a reciprocating carriage and has a plurality of printheads, each with its own ink supply cartridge, mounted on the reciprocating carriage. The nozzles in each printhead are aligned perpendicular to the line of movement of the carriage. A swath of information is printed on the stationary recording medium. The stationary recording medium is then stepped, perpendicularly to the line of carriage movement, by a distance equal to or less than the width of the printed swath. The carriage is then moved in the reverse direction to print another swath of information.

The ejecting nozzles of a fluid ejector head need to be periodically maintained, for example, by periodically cleaning the orifices when the fluid ejection system is in use, and/or by capping the fluid ejector when the fluid ejection system is not in use or is idle for extended periods. Capping the fluid ejector head prevents the fluid in the fluid ejector head from drying out. The fluid ejector also needs to be primed before it can be used. Priming the fluid ejector head ensures that the fluid ejector channels are completely filled with fluid and contain no contaminants or gas bubbles.

Periodically, priming the fluid ejector head can also be done to maintain proper functioning of the nozzles. Maintenance and/or priming stations for the fluid ejector head of various types of fluid ejection system are described in, for example, U.S. Pat. Nos. 4,855,764; 4,853,717 and 4,746,938 while removing gas from the ink reservoir of a fluid ejector head during printing is described in U.S. Pat. No. 4,679,059.

SUMMARY OF THE INVENTION

A conventional priming operation usually involves applying a sudden vacuum to the nozzles of the fluid ejector head through at least one priming element to withdraw fluid from the fluid ejector head through the at least one priming element and into a waste container. The full pressure of the vacuum is applied suddenly and over a period of relatively short duration.

The conventional priming operation is normally used to prepare newly installed fluid ejector heads or fluid ejector heads connected to newly installed fluid supply tanks, as well as to maintain already-installed or primed fluid ejector heads. This priming technique has worked well with older conventional fluid ejector head designs. However, as the resolution of the fluid ejector heads has risen, the newer fluid ejector heads are not amenable to this conventional priming technique. This appears to be due, at least in part to the finer mesh filters and somewhat more intricate channels used on higher resolution fluid ejector heads. As a result, several priming operations may need to be performed to successfully prime such higher resolution fluid ejector heads. This can be annoying to users, as the loss in time is counterproductive and multiple priming operations in rapid succession could, under some circumstances, exceed the ink delivery rate of the fluid supply tank, thus defeating the purpose of the priming operation, or, at the least, significantly raising the operating costs of the printer, overwhelming the waste fluid system of the maintenance station, or the like.

This invention provides systems and methods that apply a gradually increasing negative pressure profile to charge newly installed fluid ejector heads.

This invention separately provides systems and methods that apply a gradually increasing negative pressure profile to charge fluid ejector heads with newly installed fluid supply tanks.

This invention separately provides a method of suddenly applying the full value of the negative pressure profile and sustaining this negative pressure for a relatively short interval to prime a fluid ejector head for print quality defects and air bubble relief, as well as to unclog nozzles clogged with dirt or dried ink debris.

In various exemplary embodiments of the systems and methods according to the invention, a longer, gentler priming profile is achieved by allowing a vacuum pump to gradually generate the maximum profile vacuum while keeping open a valve that is functionally situated between the vacuum pump and the fluid ejector head.

In various exemplary embodiments of the systems and methods according to the invention, a longer, gentler priming profile is achieved by gradually opening at least one valve that is functionally situated between the maximum profile vacuum and the fluid ejector head.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

The following detailed description of various exemplary embodiments of the fluid ejection systems according to this invention are directed to one specific type of fluid ejection system, an ink jet printer, for sake of clarity and familiarity. However, it should be appreciated that the principles of this invention, as outlined and/or discussed below, can be equally applied to any known or later-developed fluid ejection systems, beyond the ink jet printer specifically discussed herein.

Figure 1:
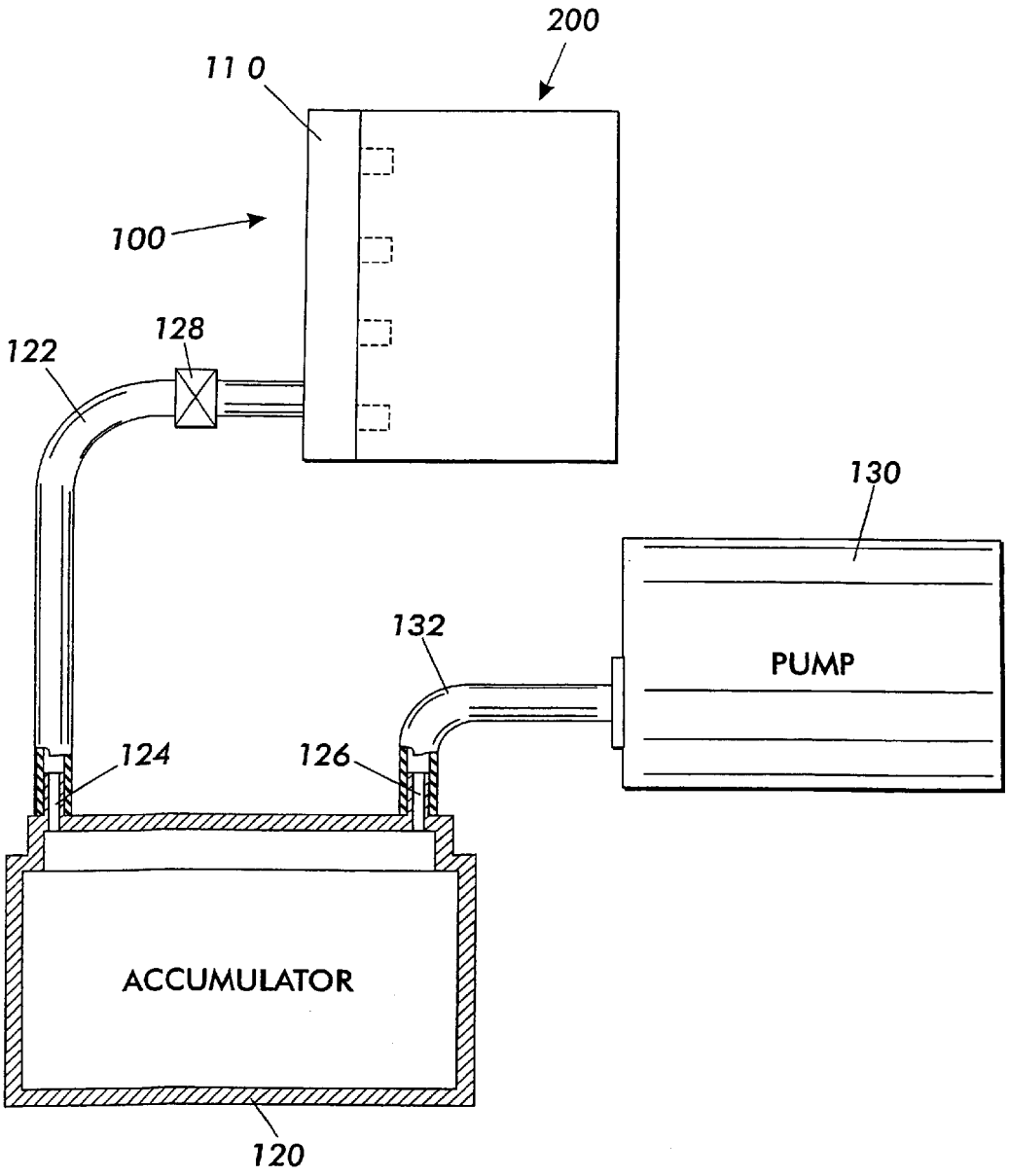
FIG. 1 is a schematic of a simplified priming/charging station.

FIG. 1 shows a simplified schematic view of an exemplary embodiment of a priming station 100 comprising a capping member 110 connected by a tube 122 to an inlet port 124 of an accumulator 120 via a valve 127. An outlet port 126 of the accumulator 120 is connected by a tube 132 to a vacuum pump 130. The printhead 200 is brought into contact with the capping member 110 during priming/charging operations.

Figure 2:
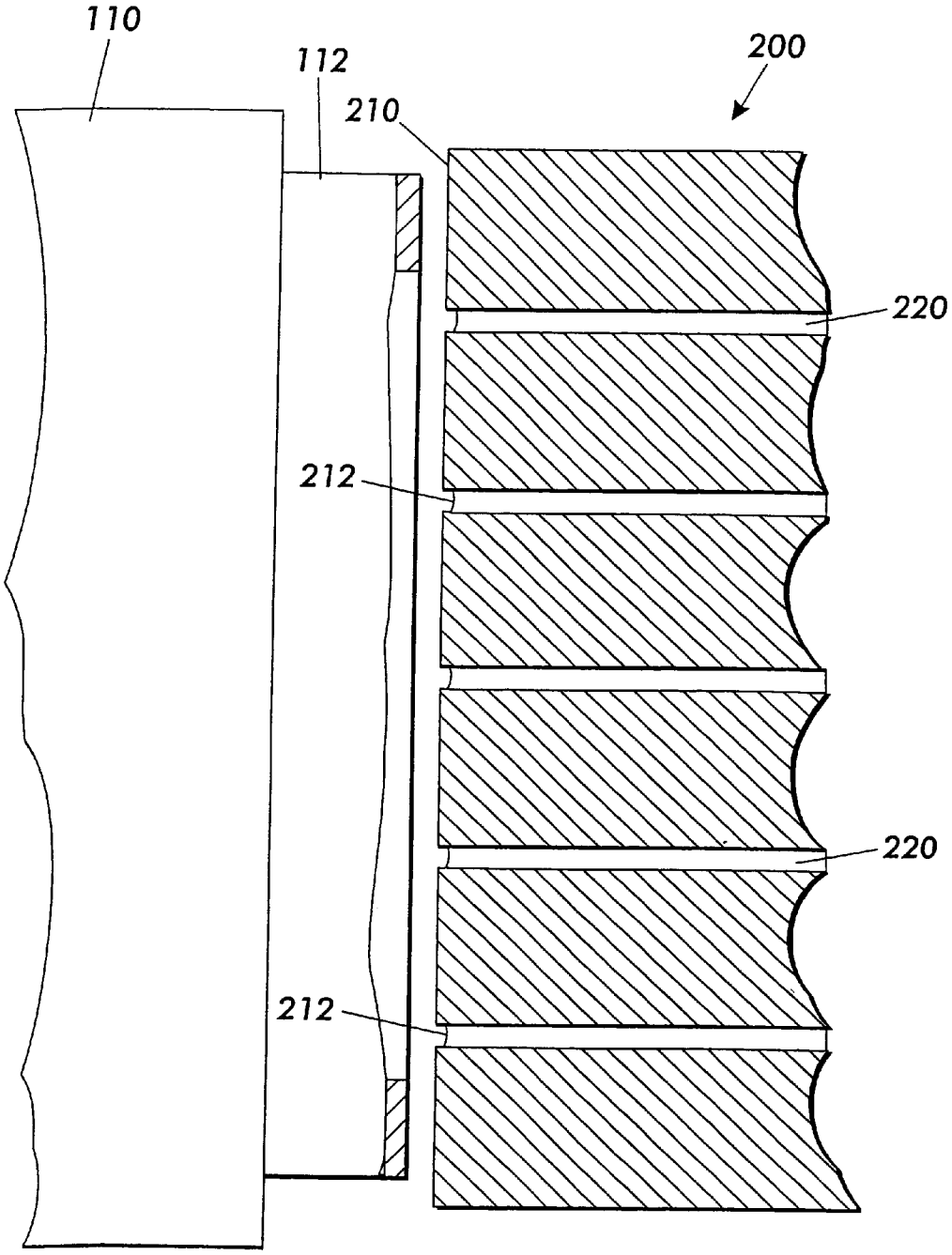
FIG. 2 is a diagrammatic sectional elevational view showing part of a fluid ejector head and the priming/charging station of FIG. 1.

FIG. 2 shows a simplified view of the printhead 200 and the capping member 110. When, the printhead 200 engages the capping member 110, a front face 210 of the printhead 200 is pressed against a priming/charging element 112 of the capping member 110. A plurality of nozzles 212 of the printhead 200 are, thus, sealed from the environment external to the inner face.

Priming the printhead 200 may be initiated at the operator's command and/or through means well known in the industry. Usually the command is given by pressing a button (not shown) or through the use of computer software. The command is then recognized by the electronic controller (not shown) of the printer that incorporates the maintenance station 100 and the printhead 200. The controller controls the priming sequence by moving the printhead 200 to a position where the printhead 200 is sealed against the capping member 110 and by controllably operating the valve 128 and the vacuum pump 130 to generate a desired pressure profile.

Figure 3:
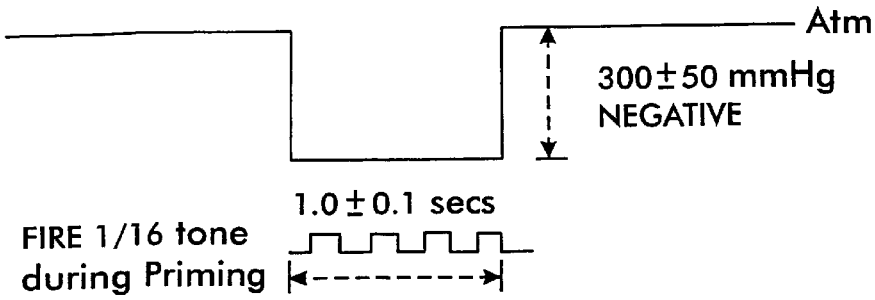
Prior Art FIG. 3
FIG. 3 graphically illustrates a conventional priming profile used to prime fluid ejector heads.

FIG. 3 shows a conventional priming profile. This priming profile represents the conventional application of a sudden vacuum of 350±50 mmHg over a period of 1.0±0.1 seconds and suddenly releasing the vacuum. In various exemplary embodiments of systems and methods according to this invention the initial pressure is about 760 mmHg or 1.0 atmosphere. This technique worked well when charging older printheads of 300 dpi or less. However, due to surface tension and flow resistance of the ink, the technique suffers when applied to newer printheads with finer mesh filters and somewhat more intricate flow channels. As the filters get finer and the flow channels grow smaller, the resistive area of contact with the ink increases and tends to make the printhead more subject to discontinuities in the flow of ink with the application of artificial vacuums. Therefore, the sudden application of any vacuum of any substantial magnitude can cause and, in practice, does cause discontinuities when the printheads are dry (i.e., newly installed) or when discontinuities exist deep in the ink flow path as, for example, those that result from the installation of new ink supply tanks.

Conventionally, while priming the printhead 200, the valve 128 is closed until the vacuum pump 130 generates the vacuum required to approximate the priming profile illustrated in FIG. 3. Once the vacuum pump 130 generates the required vacuum, the valve 128 is opened to apply the full vacuum to the printhead 200 for a short duration. In various conventional embodiments, the vacuum is applied during a priming period of about 1.0±0.1 seconds. Then, the vacuum is released by closing the valve 128. During the priming period, ink is drawn from the ink channels 220 through nozzles 212 and into the accumulator 120 via the tube 122. The printhead 200 may also be driven to fire one or more drops of ink from the ink channels 220 during priming. During partial tone firings, fractions of the number of ink channels 220 in the printhead 200 are fired in rapid succession until every ink channel 220 has been fired. FIG. 3 illustrates a 1/16 partial tone firing pattern of drops during priming. In such an arrangement, the printer will complete 16 partial firings before the priming operation is completed.

Charging the printhead 200 may be initiated automatically when at least one printhead 200 and/or at least one ink supply tank (not shown) is replaced. Installing a printhead 200 or a ink supply tank may be recognized by the controller by any known or later-developed sensory sub-system. In various conventional ink jet printers, this is usually sensed using a sensing device that acts similarly to a toggle switch. When a printhead 200 or an ink supply tank is installed, the sensing subsystem automatically signals the controller. The controller executes the charging sequence by moving at least one printhead 200 to a position where each such printhead 200 is sealed against at least one capping member 110 and by controlling the valve 128 and the vacuum pump 130 to generate the desired pressure profile.

Figure 4:
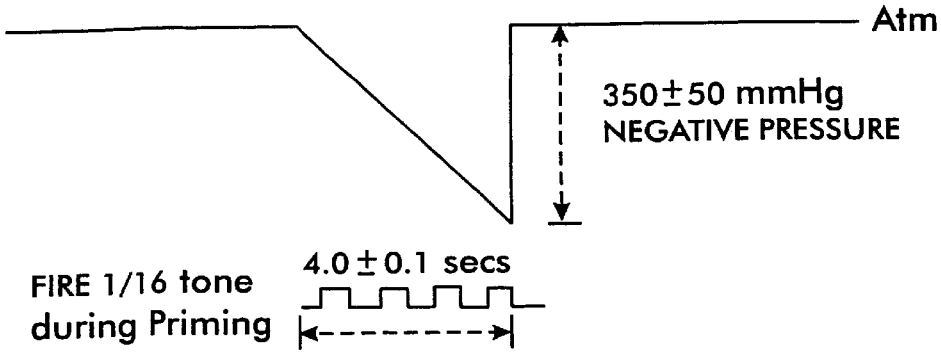
FIG. 4 graphically illustrates a gradually increasing negative pressure profile to charge fluid ejector heads according to this invention.

FIG. 4 shows a novel priming profile according to this invention. According to this invention, while charging the printhead 200, the valve 128 is open as the vacuum pump 130 generates the required vacuum. This tends to generate a profile similar to that illustrated in FIG. 4, where the vacuum gradually increases to the selected vacuum level to be used during priming. In various exemplary embodiments the selected vacuum level is 350±50 mmHg as shown in FIG. 4 and the initial pressure is about 760 mmHg or 1.0 atmosphere. During the charging period, ink is drawn from the ink channels 220 through the nozzles 212 and into the accumulator 120 via the tube 122. The maintenance station 100 may also fire partial tones during priming, as disclosed above. According to this invention, the exemplary embodiment of a priming profile according to this invention as shown in FIG. 4 results in a gentler, longer prime that enables the ink to overcome the filter resistance as well as resistance from the smaller channels 220 and/or nozzles 212 in high resolution printheads 200. The longer, gentler priming profiles according to this invention prepares the printhead 200 in less time and generally, with less ink demand than the sudden shock loading from the conventional priming profile.

While the novel priming profiles according to this invention have been disclosed as particularly useful with newer higher-resolution printheads, it should be appreciated that the novel priming profiles according to this invention can also be used with any known or later-developed printhead, for example to reduce the likelihood that the printhead will be accidentally de-primed and/or to reduce the overall amount of ink wasted during the priming operation.

It should be appreciated that, while FIG. 4 shows the novel priming profile according to this invention as a linear ramp from a first pressure to a lower second pressure over a first interval, any appreciable gradually-decreasing priming profile of any shape can be used in place of the ramp-shaped portion of the priming profile according to this invention. It should be appreciated that, in various exemplary embodiments, the first interval is about 3.9 seconds to about 4.1 seconds in duration. However, it should be appreciated that the first interval can vary considerably based on one or more of the design of the channels, of the fluid supply path between the channels and the fluid supply tank and/or of the supply tank itself, or the properties of the fluid, and the like. Thus, the first interval can be of any appropriate duration that is able to adequately prime a particular printhead 200.

Likewise, while FIG. 4 shows the novel priming profile according to this invention as a step from the lower second pressure to the higher first pressure, any appropriate increasing priming profile of any shape can be used for this portion of the priming profile, according to this invention. It should be appreciated that, in various exemplary embodiments, the second interval is about 0.1 seconds in duration or less. However, it should be appreciated that the second interval can vary considerably based on the one or more of the same factors as outlined above with respect to the first interval. Thus, the second interval can be any appropriate duration for a particular printhead 200.

It should be further appreciated that, in various exemplary embodiments of systems and methods according to the invention, more than one priming technique can be selected and implemented. Hence, in various exemplary embodiments of systems and methods according to the invention, a gentler and gradually increasing vacuum during priming, as shown in FIG. 4, may be used in a first mode and a sudden and full application of the second lower pressure, as shown in FIG. 3, may be used in a second mode. In this case, the user or a controller can select between the two modes based on any relevant factor.

While this invention has been described in conjunction with the exemplary embodiment outlined above, it is evident that many alternatives, modifications and variations will be apparent to those skilled in the art. Accordingly the exemplary embodiment of the invention as set forth above, is intended to be illustrative, not limiting. Various changes may be made without departing from the spirit and scope of the invention.

What is claimed is:

1. A method for charging a fluid ejection device comprising:

applying one of a first charging mode and a second charging mode to charge the fluid ejection device, wherein the first charging mode comprises:

gradually applying a negative pressure to a nozzle face of the fluid ejection device over a first interval to change the pressure at the nozzle face from a first pressure to a second pressure lower than the first pressure, and removing the negative pressure during a second interval; and the second charging mode comprises:

suddenly and fully applying the negative pressure to the nozzle face of the fluid ejection device during a third interval to change the pressure at the nozzle face from a third pressure to a fourth pressure lower than the third pressure, and removing the negative pressure after the third interval, wherein the third interval is substantially shorter than the first interval.

2. The method of claim 1, wherein the ink ejection device is a printhead for an ink jet printer.

3. The method of claim 1, wherein the second pressure is about 300 mmHg to about 400 mmHg lower than the first pressure.

4. The method of claim 1, wherein the first interval is about 3.9–4.1 seconds.

5. The method of claim 1, wherein the second interval is equal to or less than about 0.1 seconds.

6. A method of preparing and maintaining a fluid ejection device comprising:

applying a negative pressure to a nozzle face of the fluid ejection device by selecting either a first mode or a second mode and removing the negative pressure after applying the negative pressure to the nozzle face, wherein:

in the first mode, the negative pressure is gradually applied over a first interval to change the pressure at the nozzle face from a first pressure to a second pressure lower than the first pressure, such that fluid is drawn through at least one nozzle during the first interval, and removing the negative pressure during a second interval; and in the second mode, the, negative pressure is suddenly and fully applied during a third interval to change the pressure at the nozzle face from a third pressure to a fourth pressure lower than the third pressure, such that fluid is drawn through at least one nozzle during the third interval, wherein the third interval is substantially shorter than the first interval.

7. The method of claim 6, wherein the fluid ejection device is a printhead of an ink jet printer.

8. The method of claim 6, wherein the second pressure is about 300 mmHg to about 400 mmHg below the first pressure.

9. The method of claim 6, wherein the fourth pressure is about 250 mmHg to about 350 mmHg below the third pressure.

10. The method of claim 6, wherein the first pressure is about 760 mmHg.

11. The method of claim 6, wherein the third pressure is about 760 mmHg.

12. The method of claim 6, wherein, in the first mode, the first interval is about 3.9–4.1 seconds.

13. The method of claim 6, wherein the third interval is about 0.9–1.1 seconds.

14. The method of claim 6, wherein, in the first mode, the second interval is equal to or less than about 0.1 seconds.

15. The method of claim 1, wherein the fourth pressure is about 300 mmHg to about 400 mmHg below the third pressure.

16. The method of claim 1, wherein the third pressure is about 760 mmHg.

17. The method of claim 1, wherein the third interval is about 0.9–1.1 seconds.

18. The method of claim 6, wherein the first mode and the second mode are independent of each other.

19. The method of claim 1, wherein the first charging mode and the second charging mode are independent of each other.

* * * * *